United States Patent [19]

Buguet et al.

[11] Patent Number: 4,516,108

[45] Date of Patent: May 7, 1985

[54] ELECTRICAL RESISTOR OF STRETCHED SHEET METAL

[75] Inventors: M. Maurice Buguet, Meudon la Foret; M. Patrick Deruelle, Montbard, both of France

[73] Assignee: Le Metal Deploye, Clamart, France

[21] Appl. No.: 443,750

[22] Filed: Nov. 22, 1982

[30] Foreign Application Priority Data

Nov. 23, 1981 [FR] France ..... 81 21877

[51] Int. Cl.[3] ..... H01C 10/14

[52] U.S. Cl. ..... 338/319; 338/284; 338/287; 219/536

[58] Field of Search ..... 338/281, 283, 284, 287, 338/290, 315, 316, 318, 319; 219/536, 537

[56] References Cited

U.S. PATENT DOCUMENTS

| | | | |
|---|---|---|---|
| 1,013,157 | 1/1912 | Hadaway, Jr. | 338/287 X |
| 2,087,573 | 7/1937 | Hamilton | 338/319 X |
| 2,129,046 | 9/1938 | Clay | 338/319 X |
| 3,283,284 | 11/1966 | Eisler | 338/284 X |

FOREIGN PATENT DOCUMENTS

| | | | |
|---|---|---|---|
| 903775 | 11/1947 | France | 338/284 |

*Primary Examiner*—Volodymyr Y. Mayewsky
*Attorney, Agent, or Firm*—Brisebois & Kruger

[57] ABSTRACT

Electrical resistor of sheet metal, of the type having two U-shaped stiffeners mounted on the edges of the resistor.

It is made by cutting a sheet to constitute conductors (6) going from one edge to the other of the resistor, which are connected two by two in at least one node (7) located between the edges.

10 Claims, 4 Drawing Figures

Fig. 1
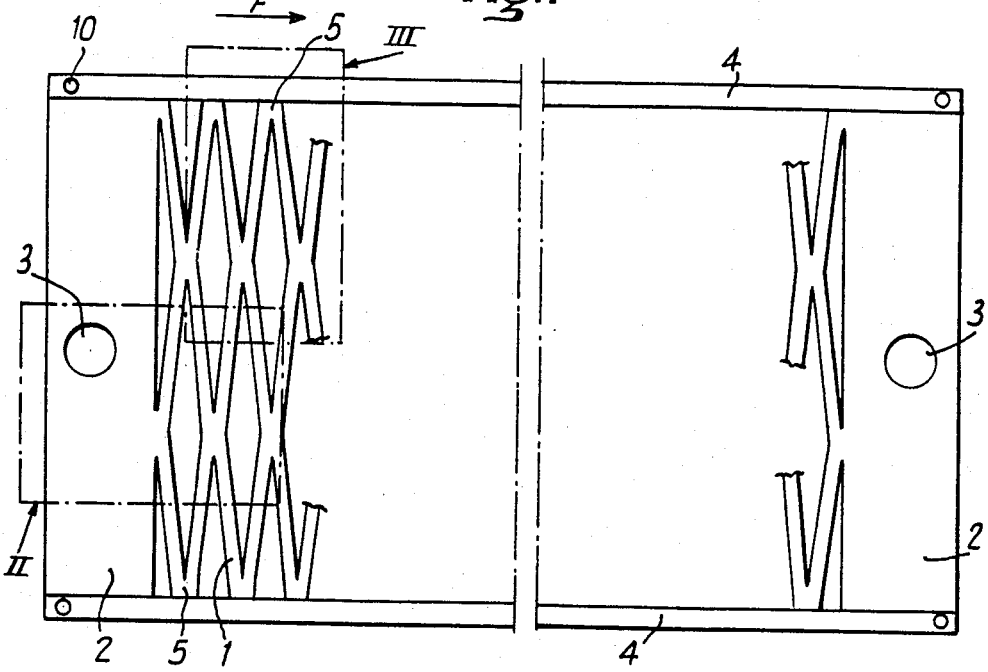
Fig. 2
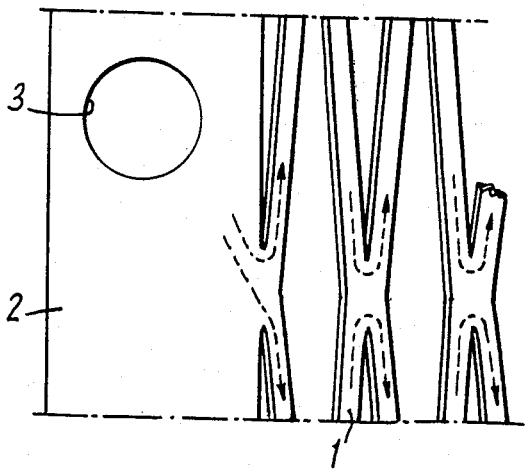
Fig. 3
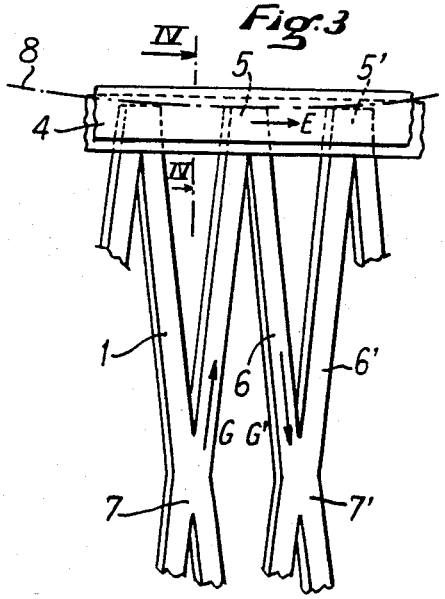
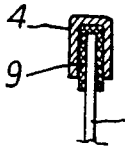
Fig. 4

ELECTRICAL RESISTOR OF STRETCHED SHEET METAL

The object of the present invention is an electrical resistor of stiffened sheet metal, that is, an electrical resistor of sheet metal of the type having two U-shaped stiffeners mounted on the edges of the resistor.

Such resistors are already known and are used particularly for the dissipation of energy and especially for heating air.

The sheet metal is cut into strips or strands constituting a loop conductor in which an electrical current flows which emits heat by the Joule effect.

Given the lack of rigidity of these cut-up sheets, especially at high temperature, they are provided with two U-shaped stiffeners along their edges, the stiffeners gripping the strips of the resistor between their two wings.

In spite of this grip there has always been the problem resulting from the sliding together of two adjacent strips which may bring them into contact and thus cause a short circuit which causes the characteristics of the resistor to vary uncontrollably and may eventually lead to the destruction of the resistor while impairing its performance.

The present invention aims to overcome these disadvantages by providing an electrical resistor of stiffened sheet metal whose different strands cannot come into contact even in the absence of the grip of the stiffener.

To this end, the object of the invention is an electrical resistor of sheet metal of the type having two U-shaped stiffeners mounted on the edges of the resistor, characterized by the fact that it is made by cutting a sheet forming conductors going from one edge to the other of the resistor which are connected two by two in at least one node located between the two edges.

It has been noted that, surprisingly, the bringing together of the strands of a resistor made according to the invention is much more difficult than the bringing together of the strands of a resistor made according to the state of the art.

It has also been noted that the grip of the stiffener is no longer indispensable, its action not being basically to keep the strands apart but to prevent any curvature of the edge of the resistor.

In one embodiment the edges are formed on the resistor along a line of nodes, but in a variation, the edges may be formed on the resistor beyond a line of nodes.

In this variation no current flows in the edges of the resistor which are located between the wings of the stiffeners so that these latter do not undergo any heating and thus maintain greater rigidity.

In one particularly advantageous embodiment, the resistor according to the invention is made of expanded metal.

In this case the expanded metal may have a regular mesh or not, and may have for example three half-meshers between its two stiffeners.

Moreover, when the stiffeners are made of metal, an electrical insulator is placed between the stiffeners and the expanded sheet metal in order to prevent the passage of the current directly from one mesh to the other.

Now by way of non-limited example, one particular embodiment of the invention will be described with reference to the attached drawings in which:

FIG. 1 is a front view of an electrical resistor according to the invention;

FIG. 2 is a larger scale view of detail II of FIG. 1;

FIG. 3 is a view of detail III of FIG. 1 also on a larger scale; and

FIG. 4 is a sectional view along the line IV≤IV of FIG. 3.

FIG. 1 shows an electrical resistor according to the invention made from an expanded metal sheet 1. Such expanded sheets are well known and are formed from sheets which are slit and stretched in the direction of arrow F.

The ends of sheet 1 form continuous solid surfaces 2 in which are formed holes 3 allowing the electrical resistor to be fastened, and the mounting of the supply cables on the solid surfaces.

The electrical current flowing, for example, as shown schematically by the arrow in FIG. 2 ensures the Joule effect in the resistor the dissipation of the electrical energy.

The resistor shown in FIG. 1 has along each of its edges, parallel to the direction of arrow F, stiffeners 4.

These stiffeners are, for example, made of a metal sheet folded in the shape of a U as is shown in FIG. 4.

In the embodiment shown on the drawing, these stiffeners 4 are fastened to expanded sheet 1 by pinching at points 10 of their ends.

In the present case it will be noted that stiffeners 4 are mounted on the resistor along lines of nodes 5 and that the resistor has two lines of intermediate nodes between its two stiffeners, that is it is formed of a mesh and a half in the direction of its width.

It will be seen from FIG. 3 that if a force E is exerted on a strand 6 tending to bring it closer to adjacent strand 6' to cause contact and thus a short-circuit at the level of corresponding nodes 5 and 5', there is created at the level of nodes 7 and 7', adjacent to node 5, forces G and G', respectively, which create a couple tending to curve, along the broken line 8 of FIG. 3, the edge formed along nodes 5 of the resistor.

Stiffener 4 in opposing this curvature prevents the bringing together of nodes 5 and 5' and the resulting short-circuit which would occur, but without it being necessary for stiffener 4 to grip each node 5.

In the present case in which stiffeners 4 are made of a metal sheet, there is provision as shown on FIG. 4 for interposing an electrical insulator 9 between the sheet and stiffener 4 to prevent the flow of current directly from one node to the other through stiffener 4.

In the embodiment shown on the drawings, expanded sheet 1 has regular meshes and the resistor has a mesh and a half in its width between the two stiffeners 4.

It has been noted that this arrangement provides good rigidity for the electrical resistor thus formed but of course other configurations are possible.

In general various modifications may be made in the embodiment described above without exceeding either the scope or the spirit of the invention.

Thus in particular, stiffeners 4 may grip the edges of the resistor along their entire length. This is, however, to be avoided where an insulator is used between the stiffeners and the resistor in order not to damage this insulator.

We claim:

1. An electrical resistor having sides and ends and comprising, a metal sheet cut to form a generally planar pattern of integrally connected conductors extending between said ends and to edges of said sides, said conductors defining a plurality of current paths between said ends, said conductors being integrally joined in at least one node spaced from the sides and ends and comprising a junction of at least two conductors, and an electrically insulated U-shaped stiffener mounted on each side edge of said resistor, each stiffener being continuous and extending around the conductors at a side edge, said U-shaped stiffeners being fastened only to portions of said side edges at spaced apart locations and at least at locations adjacent the ends of the resistor, so that there are unfastened portions of the side edges between the fastening locations, and wherein said U-shaped stiffeners confine the unfastened portions of the edges between the fastening locations to prevent curving of the edges.

2. An electrical resistor according to claim 1 wherein said conductors along each side edge comprising a line of nodes.

3. An electrical resistor according to claim 1 wherein said conductors along each side edge comprise edges of conductors outwardly of a line of nodes.

4. An electrical resistor according to claim 1 wherein said metal sheet comprises an expanded metal sheet, and said pattern of conductors comprises a mesh pattern.

5. An electrical resistor according to claim 4 wherein said pattern comprises a pattern of regular meshes.

6. An electrical resistor according to claim 5 wherein said pattern comprises three half-meshes between said side edges.

7. An electrical resistor according to claim 1 wherein said electrically insulated U-shaped stiffeners each comprise a U-shaped metal stiffener body, and electrical insulating means between each metal stiffener body and said conductors, for electrically insulating said conductors from the metal body of said stiffeners.

8. An electrical resistor according to claim 1 wherein said resistor is generally rectangular.

9. An electrical resistor according to claim 1 wherein said current paths comprise a plurality of zig-zag current paths.

10. An electrical resistor according to claim 1 wherein said electrically insulated U-shaped stiffeners are fastened to said edges only at locations adjacent the ends of the resistor.

* * * * *